US006186858B1

(12) United States Patent
Cotoia

(10) Patent No.: US 6,186,858 B1
(45) Date of Patent: Feb. 13, 2001

(54) DEVICE FOR HOLDING AND CONTROLLING A STRING-RETAINED ARTICLE

(76) Inventor: Robert C. Cotoia, 580 Highland Ave., Needham, MA (US) 02194

( * ) Notice: Under 35 U.S.C. 154(b), the term of this patent shall be extended for 0 days.

(21) Appl. No.: 09/400,395

(22) Filed: Sep. 21, 1999

(51) Int. Cl.[7] ..... A63H 1/30
(52) U.S. Cl. ..... 446/250; 446/26; 224/217
(58) Field of Search ..... 446/250, 247, 446/248, 249, 251, 252, 253, 254, 236, 26; D11/39; 57/279; 112/279; 16/446; 24/230 A, 311; 224/217, 218, 219, 220, 221; 242/405.1, 118.4, 580, 588, 600

(56) References Cited

U.S. PATENT DOCUMENTS

| | | | | |
|---|---|---|---|---|
| D. 262,199 | * | 12/1981 | Bogner et al. | D11/39 |
| 2,603,429 | * | 7/1952 | Jaworowski et al. | 242/405.1 |
| 4,273,275 | | 6/1981 | Vadnais . | |
| 5,127,868 | | 7/1992 | Smollar . | |
| 5,562,512 | * | 10/1996 | Samelian | 441/81 |

* cited by examiner

*Primary Examiner*—Sam Rimell
*Assistant Examiner*—Urszula M. Cegielnik
(74) *Attorney, Agent, or Firm*—O'Connell Law Firm

(57) ABSTRACT

A device for holding and controlling a string-retained article, such as a yo-yo, wherein the device comprises an annular ring of rigid material with a smooth annular channel formed in an outer surface of the ring. The annular channel is defined by an annular base ring and first and second annular ridges. A loop of a string can be retained in the channel so that the ring will be interposed between a body part of a user and the loop of the string to prevent constriction of the loop about the body part of the user. The ring can be used in practicing a method for holding and controlling a string-retained article comprising the steps of providing a string, the ring, and a string-retained article such as a yo-yo; coupling a first end of the string to the string-retained article, forming a second end of the string into a loop; disposing the loop of the string in the channel of the ring; and inserting a body part of a user through the aperture in the ring. Where the string-retained article is a yo-yo, one could further wrap the string around an axle of the yo-yo until the yo-yo is disposed adjacent to the ring, cast the yo-yo from the body part of the user to cause the string to unwrap and the yo-yo to gain angular momentum, and then induce the yo-yo to return to a position adjacent to the ring.

11 Claims, 2 Drawing Sheets

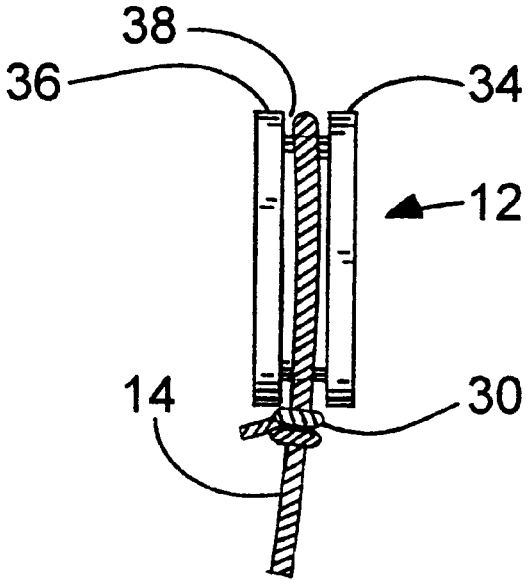
FIG. 2
FIG. 3
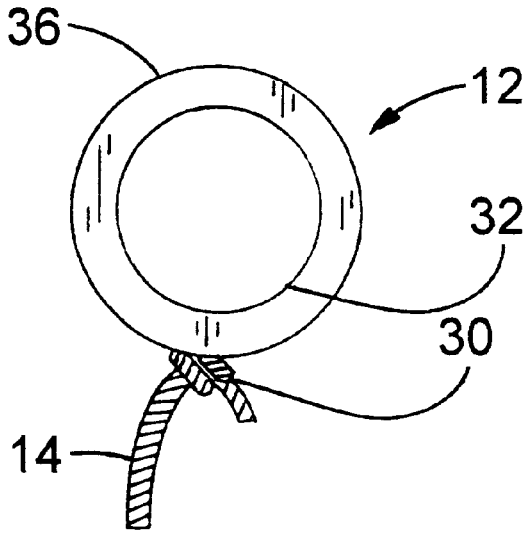

DEVICE FOR HOLDING AND CONTROLLING A STRING-RETAINED ARTICLE

FIELD OF THE INVENTION

The present invention relates to amusement devices. Stated more particularly, disclosed herein is a device for holding and controlling an article that is retained by a string, such as a yo-yo.

BACKGROUND OF THE INVENTION

As is nearly universally known, a yo-yo typically comprises a pair of disks joined by an axle at their centers and separated by a furrow thereby creating a flattened spool. A dual-strand string has a first end looped over the axle. The string extends from its first end within the furrow to a second end that is normally attached to a user's finger by a slipknot or the like.

In use, the string will be wound around the axle repeatedly and, therefore, upon itself within the furrow. With this, the yo-yo spool will be disposed immediately adjacent to the second end of the string and, thus, adjacent to the user's retaining finger. In a basic yo-yo cycle, the user will then cast the spool away from his or her hand thereby causing the string to unfurl and the spool to gain angular momentum. When the string is fully extended, the angular momentum of the spool will tend to cause it to continue spinning such that it will roll up the string to re-assume its original position adjacent to the user's hand where it is ready for another cycle. Of course, the skilled yo-yo player will be capable of performing a variety of additional and more complicated tricks.

For a limited number of such cycles, the yo-yo can be used without notable discomfort. However, as anyone who has used a yo-yo will be well aware, extended yo-yo use inevitably results in significant discomfort to the user. This discomfort results, for example, from the fact that a slipknot is commonly employed for surrounding the user's finger. With continued usage, the opening in the slipknot will tend to shrink thereby becoming increasingly tighter around the user's finger. Eventually, the shrinking opening will cut off circulation to the user's finger thereby forcing the user to cease play with the yo-yo to allow circulation to return to the finger and, possibly, to retie the knot. Another problem, which leads to substantially identical results, is that continued use of the yo-yo will cause the string to become twisted thereby further twisting and shrinking the loop around the user's finger.

To be complete, one should note that, even without any shrinking of the loop, the consistent pressure of the narrow string against the user's finger eventually causes discomfort and possible loss of circulation. A further problem exhibited by prior art devices is that the entire string, including its second end with the finger loop, can become wedged and tangled within the furrow between the disks. Dislodging the string from the furrow can be a time consuming and frustrating task that may demand ultimately a cutting and replacement of the yo-yo string.

Advantageously, a number of inventors have recognized these and further problems exhibited by the prior art and have attempted to provide workable solutions thereto. For example, in U.S. Pat. No. 5,127,868, Smollar discloses a device for holding or controlling a yo-yo. The device essentially comprises a resilient, rubberized or plastic O-ring. The second end of the yo-yo string is connected to the O-ring such that the string can be passed through the O-ring to create a loop defined by the combination of the string and the O-ring. Under this arrangement, it is said, the loop will tighten about the user's finger during the downward portion of the yo-yo cycle but will loosen from around the users finger during the upward portion of the cycle thereby preventing loss of circulation and the like.

Unfortunately, the Smollar device and others with similar aims have left a number of problems as of yet unsolved. For example, even assuming that the Smollar device is successful in causing the noose-like pressure of the string/O-ring loop to be intermittent, the pressure exists nonetheless. With this, discomfort and lack of circulation can continue to afflict one hoping to play with a yo-yo for extended periods of time. Furthermore, as the skilled yo-yo player will appreciate, a number of yo-yo tricks (e.g., the "Around the World" trick) may require for their proper practice that the loop rotate about the user's finger. Disadvantageously, with Smollar's resilient ring forming a part of the loop, the ring inevitably would prevent the loop from freely rotating about a user's finger thereby leading to a number of potential problems. By way of example, the string can become wrapped and tangled about the user's finger thereby hindering or altogether preventing continued play with the yo-yo.

In light of the foregoing, it becomes clear that a device for holding and controlling a yo-yo or similar stringed device that provides a solution to one or more of the aforementioned deficiencies exhibited the prior art would be useful. It is clearer still that a device for controlling a yo-yo or other stringed device presenting a solution to each and every problem left by the prior art while providing a number of heretofore unrealized advantages would represent a marked advance in the art.

SUMMARY OF THE INVENTION

Advantageously, the present invention sets about with the broadly stated object of providing a device for controlling a yo-yo or similar string-retained article that meets the needs left unmet by the prior art while markedly improving on the functionality of the prior art.

Stated more particularly, a primary object of the present invention is to provide a device for controlling a yo-yo or similar string-retained article that prevents a finger loop from constricting about a user's finger during yo-yo play.

A resultant object of the present invention is to enable a user to play with a string-retained article comfortably and safely over extended periods of time.

A further object of the invention is to provide a device for controlling a yo-yo or the like that accomplishes the foregoing while not hindering, and ideally assisting, a user in practicing tricks with the article.

A related object of the invention is to provide a device for controlling a yo-yo or the like that accomplishes the foregoing objects while nonetheless allowing a user to sense vibrations emanating from a rotating yo-yo spool or similar device for enabling optimum use and control of the yo-yo or similar device.

Undoubtedly, these and further objects and advantages of the present invention will become obvious both to one who reviews the present disclosure and to one who has an opportunity to make use of an embodiment of the present invention.

In accomplishing the aforementioned objects, one most basically stated embodiment of the present invention for a device for holding and controlling a string-retained article essentially comprises a ring with an aperture, an outer surface, and a channel formed in the ring's outer surface. Under this arrangement, a loop of a string can be retained within the channel in the outer surface of the ring such that, when the ring is worn about a body part of a user, the ring will be interposed between the body part and the loop of the string. Advantageously, this will prevent the loop from constricting about the body part of the user to allow continued use of the string-retained article without discomfort or danger.

In preferred embodiments, the ring and the channel will be annular, and the ring will be formed from a substantially rigid material with an annular base ring and first and second annular ridges that project from the base ring. With this, the channel will be defined by the base ring and the first and second annular ridges. Of course, the ring may be supplemented by a string with a first end and a second end and a string-retained article, such as a yo-yo spool, whereby the first end of the string can be coupled to the string-retained article and the second end of the string can be formed into a loop for being received and retained by the channel in the ring. Preferably, the channel in the ring will be smooth whereby a loop of a string that is retained within the channel can rotate freely and without obstruction about the ring and, thus, about a body part on which the ring is retained.

Of course, one should remain mindful that the foregoing discussion is designed merely to outline broadly the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of possible manifestations of the invention.

BRIEF DESCRIPTION OF THE DRAWINGS

In the accompanying drawings:

FIG. 2 is a view in front elevation of the device for holding and controlling a string-retained article of FIG. 1; and FIG. 3 is a view in side elevation of the device for holding and controlling a string-retained article of FIG. 1.

DETAILED DESCRIPTION OF PREFERRED EMBODIMENTS

Figure 1:
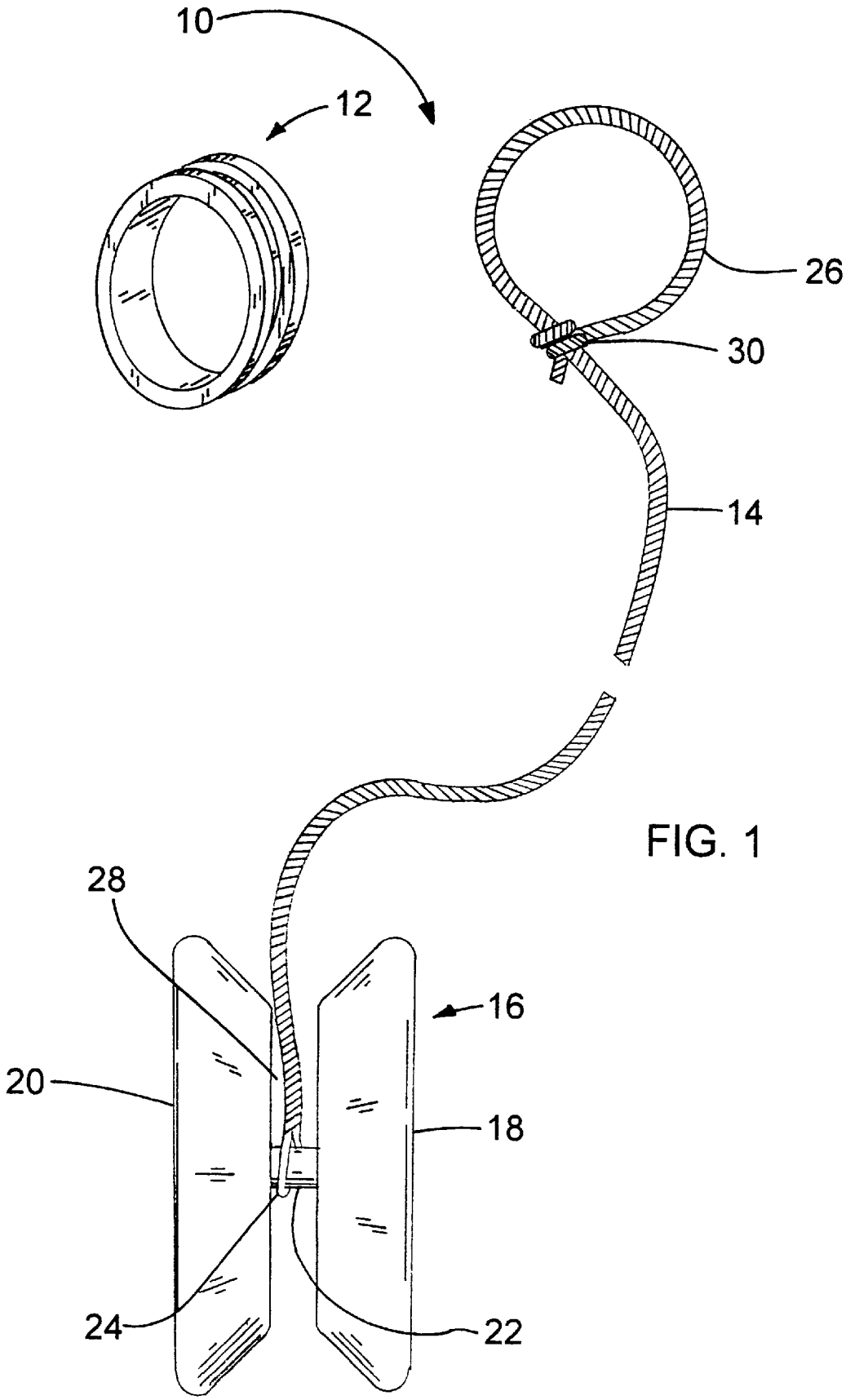
FIG. 1 is a perspective view of an embodiment of the present invention for a device for holding and controlling a string-retained article, which is shown as a yo-yo.

As with many inventions, the present invention for a device for holding and controlling a string-retained article, such as a yo-yo, can assume a wide variety of embodiments. However, to assist those reviewing the present disclosure in understanding and, in appropriate circumstances, practicing the present invention, a preferred embodiment of the instant invention for a device for holding and controlling a yo-yo or other string-retained article will be disclosed hereinafter.

Looking more particularly to the drawings, a preferred embodiment of the present invention for a device for holding and controlling a yo-yo or other string-retained article is indicated generally at 10 in FIG. 1. The device for holding and controlling a string-retained article 10 is founded on what may be termed a yo-yo ring 12 for being worn on a body part of a user, such as a finger. In practice, a string 14 couples the yo-yo ring 12 to a yo-yo spool 16. The yo-yo spool 16 comprises first and second disks 18 and 20 that are coupled together by an axle 22 such that they are separated by a furrow 28.

The string 14 is formed from a single length of material that is folded back upon itself and twisted into the configuration shown in FIG. 1. With this configuration, a first end 24 of the string 14 can be opened, slipped over one of the disks 18 or 20, and allowed to re-twist to surround the axle 22. A second end 26 of the string 14 can be formed into a finger loop, which is also indicated at 26, by the tying of a slipknot 30, disposed around the yo-yo ring 12, and then slid upon itself to surround the yo-yo ring 12 snugly. The user can then slide the yo-yo ring 12 over his or her finger such that the string 14 and, thus, the yo-yo spool 16 can be held and controlled for extended periods of use.

To provide a better understanding of the invention, the yo-yo ring 12 is shown in larger views in FIGS. 2 and 3 with the finger loop 26 of the string 14 operably associated with the yo-yo ring 12. By combined reference to FIGS. 1, 2, and 3, one sees that the yo-yo ring 12 is formed with a smooth annular base ring 32. Smooth first and second annular ridges 34 and 36 extend from the base ring 32 whereby the base ring 32 and the first and second annular ridges 34 and 36 together define a smooth annular channel 38, which is disposed at a periphery of the yo-yo ring 12.

The yo-yo ring 12 certainly can be formed from a wide variety of materials. Preferably, however, it will be formed from a substantially rigid and durable material, such as metal, plastic, or any other suitable material. For example, one preferred embodiment of the invention forms the yo-yo ring 12 from a single piece of brass that can be polished for greatest smoothness. The size of the aperture defined by the base ring 32 certainly can be varied widely within the scope of the invention. However, in light of this embodiment's being designed to be worn about a user's finger, it would certainly seem preferable to construct the invention with varied aperture sizes corresponding to possible male and female ring sizes. To ensure greatest comfort and enjoyment, a user could select a yo-yo ring 12 that presents an aperture suitably sized for his or her yo-yo wielding finger.

Advantageously, the annular channel 38 readily and securely retains the finger loop 26 of the string 14. During use of the invention, the yo-yo ring 12 will be interposed between the user's finger and the finger loop 26 of the yo-yo string 14. Advantageously, the smoothness of the base ring 32 and the first and second ridges 34 and 36 allow the finger loop 26 and, thus, the entire yo-yo string 14 to rotate absolutely freely and without obstruction about the yo-yo ring 12 and, thus, the user's finger.

Under this arrangement, the plural objects of the invention are realized. For example, the invention completely prevents the loop 26 of the yo-yo string 14 from constricting about the user's finger during yo-yo play by interposing the yo-yo ring 12 between the loop 26 of the yo-yo string 14. With this, a user can play with a yo-yo vigorously for extended periods of time with substantially no discomfort or danger from constriction or loss of circulation. Furthermore, the smoothness of the base ring 32 and the first and second ridges 34 and 36 not only does not hinder a user who seeks to perform tricks that may require rotation of the finger loop 26 relative to a user's finger (e.g., the "Around the World" trick), but the invention also actually assists the user in performing such tricks by presenting a surface that is smoother and more durable than even the periphery of a user's finger. Yet further, a user's ability to control a yo-yo or other string-retained article 10 is assisted by the ability of the yo-yo ring 12 to transmit vibrations emanating from a rotating yo-yo spool 16 directly to a user's finger. Of course, the astute observer and user of the present invention will identify and appreciate still further advantages that are provided by the present invention.

The proper manner of using the present invention may well be clear in light of the foregoing disclosure. Nonetheless, to ensure a most complete understanding of the invention, a method for using the device for holding and controlling a string-retained article 10 will be described hereinafter. Of course, the method would begin with providing a string 14 with a first end 24 and a second end 26, providing a ring 12 with an aperture, an outer surface, and a channel 38 formed in the outer surface, and providing a string-retained article, such as the yo-yo spool 16. One would then couple the first end 24 of the string 14 to the yo-yo spool 16, form the second end 26 of the string 14 into a loop 26, and then dispose the loop 26 in the channel 38 of the ring 12 whereby the loop 26 surrounds the ring 12. One would then insert a body part of a user through the aperture in the ring 12 whereby the ring 12 would then be interposed between the loop 26 of the string 14 and the body part of the user for preventing the loop 26 from constricting about the body part of the user. Where a yo-yo spool 16 is employed, one could further wrap the string 14 around the axle 22 of the yo-yo spool 16 repeatedly until the yo-yo spool 16 is disposed adjacent to the ring 12 and, thus, the body part of the user, cast the yo-yo spool 16 from the body part of the user to cause the string to unwrap and the disks 18 and 20 of the yo-yo spool 16 to gain angular momentum, and then induce the yo-yo spool 16 to return to a position adjacent to the ring 12 and the body part of the user.

Naturally, one must appreciate that the invention has been shown for use relative to a yo-yo spool 16 for illustrative purposes. It will be appreciated that the invention be employed relative to a multiplicity of other string-retained articles. For example, one could readily use the invention for controlling a kite, possibly by employing multiple embodiments of the invention on a number of the user's fingers. Furthermore, an embodiment of the invention could easily be used for retaining a proximal, looped end of a string that is employed as a fishing line with the distal end of the string retaining a hook or lure. Even further still, one could use an embodiment of the invention for tethering an animal, though probably a small one. Further possible uses of the device for holding and controlling string-retained articles 10 undoubtedly will occur to one who learns of the invention.

Also, it will be clear that the present invention has been shown and described with reference to a certain preferred embodiment that merely exemplifies the broader invention revealed herein. Certainly, those skilled in the art can conceive of alternative embodiments. For instance, those with the major features of the invention in mind could craft embodiments that incorporate those major features while not incorporating all of the features included in the preferred embodiments. With the foregoing in mind, the following claims are intended to define the scope of protection to be afforded the inventor, and the claims shall be deemed to include equivalent constructions insofar as they do not depart from the spirit and scope of the present invention.

One should note that a plurality of the following claims may express certain elements as a means for performing a specific function, at times without the recital of structure or material. As the law demands, these claims shall be construed to cover not only the corresponding structure and material expressly described in the specification but also equivalents thereof.

I claim as deserving the protection of United States Letters Patent:

1. A combination of a string retained article and a device for holding and controlling the string-retained article, the combination comprising:

a string-retained article comprising a yo-yo spool comprising a pair of disks coupled together by an axle and separated by a furrow;

a device for holding and controlling the string-retained article wherein the device comprises a ring with an aperture, an outer surface, and a channel formed in the outer surface of the ring; and a string with a first end and a second end wherein the first end of the string is coupled to the axle of the yo-yo spool and wherein the second end of the string comprises a loop that is received and retained by the channel in the outer surface of the ring;

whereby, when the ring is worn about a body part of a user, the ring will be interposed between the body part and the loop of the string thereby preventing the loop of the string from constricting about the body part of the user.

2. The device for holding and controlling a string-retained article of claim 1 wherein the ring and the channel are annular.

3. The device for holding and controlling a string-retained article of claim 2 wherein the ring comprises an annular base ring and first and second annular ridges that project from the base ring and wherein the channel is defined by the base ring and the first and second annular ridges.

4. The device for holding and controlling a string-retained article of claim 1 wherein the ring is formed from a substantially rigid material.

5. The device for holding and controlling a string-retained article of claim 1 wherein the channel in the ring is smooth whereby a loop of a string that is retained within the channel can rotate freely and without obstruction about the ring and, thus, about a body part on which the ring is retained.

6. A method for holding and controlling a string-retained article with a combination of a string retained article and a ring for holding and controlling the string-retained article, the method comprising the steps of:

providing a string with a first end and a second end;

providing a ring with an aperture, an outer surface, and a channel formed in the outer surface;

providing a string-retained article comprising the step of providing a yo-yo spool comprising a pair of disks coupled together by an axle and separated by a furrow;

coupling the first end of the string to the axle of the yo-yo spool;

forming the second end of the string into a loop;

disposing the loop of the second end of the string in the channel of the ring whereby the loop of the second end of the string surrounds the ring; and inserting a body part of a user through the aperture in the ring whereby the ring is interposed between the loop of the second end of the string and the body part of the user for preventing the loop of the second end of the string from constricting about the body part of the user.

7. The method for holding and controlling a string-retained article of claim 6 further comprising the step of wrapping the string a round the axle of the yo-yo spool repeatedly until the yo-yo spool is disposed adjacent to the ring and, thus, the body part of the user.

8. The method for holding and controlling a string-retained article of claim 7 further comprising the step of casting the yo-yo spool from the body part of the user whereby the string unwraps from around the axle of the yo-yo spool and the disks of the yo-yo spool gain angular momentum.

9. The method for holding and controlling a string-retained article of claim 8 further comprising the strep of inducing the yo-yo spool to return to a position adjacent to the ring and the body part of the user.

10. The method for holding and controlling a string-retained article of claim 6 wherein the step of providing a ring with an aperture, an outer surface, and a channel formed in the outer surface comprises the step of providing a ring with an annular aperture, an outer surface, and an annular channel in the outer surface.

11. The method for holding and controlling a string-retained article of claim 10 wherein the step of providing a ring with an annular aperture, an annular base ring annular channel in the outer surface comprises the step of providing an annular base ring defining an annular aperture and second annular ridges that project from the base ring to define an annular channel with the annular base ring.

* * * * *